US007095300B2

(12) United States Patent
Andoh

(10) Patent No.: US 7,095,300 B2
(45) Date of Patent: Aug. 22, 2006

(54) BAND ELIMINATE FILTER AND COMMUNICATION APPARATUS

(75) Inventor: Masamichi Andoh, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/435,055

(22) Filed: May 12, 2003

(65) Prior Publication Data

US 2003/0218521 A1 Nov. 27, 2003

(30) Foreign Application Priority Data

May 23, 2002 (JP) ..... 2002-149282

(51) Int. Cl.
*H01P 1/202* (2006.01)

(52) U.S. Cl. ..... 333/206; 333/176

(58) Field of Classification Search ..... 333/176, 333/202, 203, 206, 207, 222
See application file for complete search history.

(56) References Cited

U.S. PATENT DOCUMENTS 3,792,385 A * 2/1974 Napoli et al. ..... 333/224
4,382,238 A * 5/1983 Makimoto et al. ..... 333/134
4,713,633 A * 12/1987 Saito et al. ..... 333/222
6,066,994 A * 5/2000 Shepherd et al. ..... 333/109

FOREIGN PATENT DOCUMENTS

| | | |
|---|---|---|
| JP | 1-103001 | 4/1989 |
| JP | 02-034001 | 2/1990 |
| JP | 3-113507 | 11/1991 |
| JP | 04-188902 | 7/1992 |
| JP | 5-166675 | 7/1993 |
| JP | 06-066103 | 9/1994 |
| JP | 11-274817 | 10/1999 |

OTHER PUBLICATIONS

Copy of Japanese Examination Report dated Dec. 13, 2005 (and English translation of same).

* cited by examiner

*Primary Examiner*—Timothy P. Callahan
*Assistant Examiner*—Terry L. Englund
(74) *Attorney, Agent, or Firm*—Dickstein, Shapiro, Morin & Oshinsky, LLP

(57) ABSTRACT

A coaxial capacitor is inserted in a coaxial cable in a predetermined position. A housing is provided as a ground conductor path in order to establish conduction between two external conductors in portions of the coaxial cable which are separated by the inserted coaxial capacitor. Inside the housing, a resonator formed by a dielectric coaxial resonator or the like, the coaxial capacitor, and a connecting conductor are accommodated.

8 Claims, 8 Drawing Sheets

BAND ELIMINATE FILTER AND COMMUNICATION APPARATUS

BACKGROUND OF THE INVENTION

1. Field of the Invention

The present invention relates to a band eliminate filter suitable for use in, for example, a high-frequency high-power system, and a communication apparatus including the band eliminate filter.

2. Description of the Related Art

Band eliminate filters for use in a high power system include an example as disclosed in Japanese Unexamined Patent Application Publication No. 11-274817 in which a waveguide and a cavity resonator are used. As shown in the above Publication, a problem in a filter for use in a high power system is discharge (arc discharge) at high power (high voltage). Also, recently, it is common that band eliminate filters are used in base stations for mobile communication. This case not only obviously requires measures for high power (high voltage), but also requires a filter having a very low loss in the vicinity of an attenuation range because of proximity of operating bands in recent years.

Although it is considered that the invention in Japanese Unexamined Patent Application Publication No. 11-274817 has durability against power and a low loss since the waveguide and the cavity resonator are used, the invention has a problem in that filter size is very large.

In addition, as shown in Japanese Unexamined Patent Application Publication No. 04-188902, Japanese Unexamined Utility Model Application Publication No. 06-066103, and Japanese Unexamined Patent Application Publication No. 02-034001, in each of commonly invented band eliminate filters, a dielectric resonator is used as a resonator, microstrip lines formed by a dielectric substrate are used as transmission lines, and a plane chip capacitor or a distributed-constant capacitor formed on the substrate is used as a capacitor. Although this type of band eliminate filter can be reduced in size, it has a possibility that many small gaps between electrodes may discharge at high power (high voltage), and the microstrip lines generally have large loss, thus causing a deterioration in insertion loss. Also, the chip capacitor and the capacitor formed on the microstrip lines cause a deterioration in insertion loss of a passband in the vicinity of an attenuation range since the capacitors each have Q.

When the passband is very close to the attenuation range, a reflection characteristic (return loss) in the vicinity of the attenuation range must be improved. For example, in the case of generating a return loss peak in the vicinity of the lower side of the attenuation range, the capacitance of the capacitors must be reduced. Due to the required characteristic, when the capacitance of the capacitors is very small, the use of the dielectric plane capacitor and the chip capacitor greatly reduces the size, so that assembly is difficult. In the case of the small size, differences in dimension precision of electrodes, dimension precision of dielectric material, and dielectric constant appear as a change in capacitance. Thus, a difference easily occurs in characteristics, which requires adjustment. Similarly, a difference in assembly easily appears as a change in capacitance, thus causing a difference in characteristics. For example, when a capacitance of 0.5 pF is obtained by a dielectric chip capacitor having a dielectric constant of 21 and a thickness of 1 mm, the shape of the chip capacitor is square, having each side of 1.63 mm. In this case, only a minute change of 0.05 mm in one side causes a 5-percent change in capacitance. Similarly, a change of 0.05 mm in thickness also causes a 5-percent change in capacitance. The 5-percent change generates a change of approximately 15 MHz in the return loss peak and a change of approximately 12 MHz in the attenuation peak. Also, since the case of adjusting the capacitance of the capacitors requires very high processing precision, a lot of experience is required.

FIGS. 8A and 8B show examples of characteristics of a band eliminate filter in which one stage of a resonator is coupled to a transmission line. FIG. 8A shows transmission characteristics S21 and S11 in a case in which the capacitance of the capacitor of the band eliminate filter is 0.290 pF, and FIG. 8B shows the transmission characteristics S21 and S11 in a case in which the capacitance of the capacitor of the band eliminate filter is 0.387 pF. In both cases, identical component values are used, except for the capacitance.

As shown in FIGS. 8A and 8B, when the capacitance of the capacitor for coupling the resonator with the transmission line changes only approximately 33 percent, the central frequency of the elimination band greatly changes from 1994.75 MHz to 1936.81 MHz. Also, an increase in the capacitance of the capacitor lowers the peak of the attenuation range, but increases the distance between the return loss peak and the peak of the attenuation range.

SUMMARY OF THE INVENTION

It is an object of the present invention to provide a band eliminate filter which has a low insertion loss and high frequency stability and which is suitable for use in a high power system, and a communication apparatus including the band eliminate filter.

According to an aspect of the present invention, a band eliminate filter is provided which includes a coaxial line having a coaxial capacitor inserted therein in a predetermined position, a ground conductor path for establishing electrical conduction between two external conductors in portions of the coaxial line which are separated by the inserted coaxial capacitor, and a resonator connected to junctions of the external conductors and the ground conductor path.

In this structure, a band eliminate filter is obtained which has high durability, a low insertion loss, easiness in assembly, a difference in electrostatic capacitance due to a difference in assembly, and stable characteristics.

Preferably, the coaxial capacitor includes a portion of an inner conductor of the coaxial line in an external-conductor-removed portion in which an external conductor in a portion of the coaxial line is removed in a band shape, and a capacitance conductor which combines with the portion of the inner conductor to generate an electrostatic capacitance. Also, the need to perform the operation of connecting the coaxial capacitor and the coaxial line is eliminated, thus achieving cost reduction.

This forms a structure in which a coaxial capacitor is connected to a coaxial line without using a coaxial capacitor as a single component.

The coaxial line may be a semi-rigid cable in which the surface of an inner conductor of the cable is coated with insulating resin and the coated surface is covered with metal forming a metal tube as an external conductor.

This achieves cost reduction of components, and good processability is obtained, thus achieving total cost reduction.

The capacitance conductor may be a piece of metal which is wound around the external-conductor-removed portion and which has no contact with the external conductors in the portions of the coaxial line.

This facilitates a process, thus achieving cost reduction.

A coaxial connector is provided in each of two positions which are separated from the center of the coaxial capacitor along the coaxial line in a signal-transmitted direction and the opposite direction thereto by approximately an eighth of the wavelength at the central frequency of an elimination band.

This enables the formation of a plurality of stages only by connecting band eliminate filters having identical structures. In addition, since the band eliminate filters as units can be separately adjusted, the adjustment is greatly facilitated, thus enabling large cost reduction.

According to another aspect of the present invention, a communication apparatus including the band eliminate filter is provided.

For example, by using the band eliminate filter as a filter for eliminating an unnecessary frequency band in a transmitting signal or a received signal, a communication apparatus for a high power system which has high power efficiency and high frequency stability is obtained.

DESCRIPTION OF THE PREFERRED EMBODIMENTS

A band eliminate filter set according to a first embodiment of the present invention is described below with reference to FIGS. 1 to 4.

Figure 1:
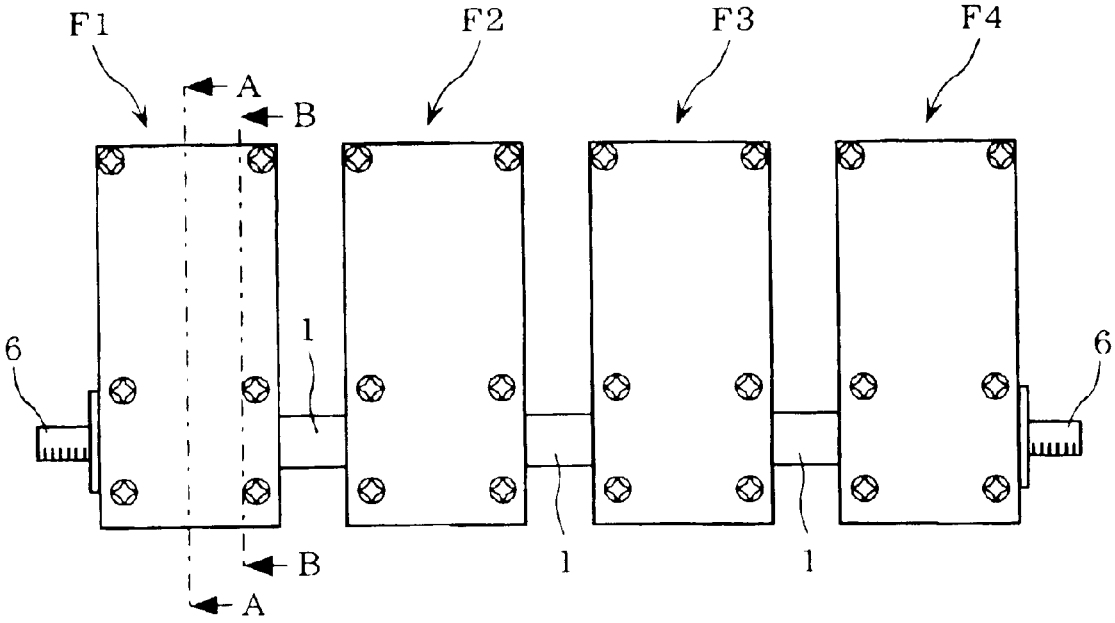
FIG. 1 is a top view showing a band eliminate filter set according to a first embodiment of the present invention.
Figure 2:
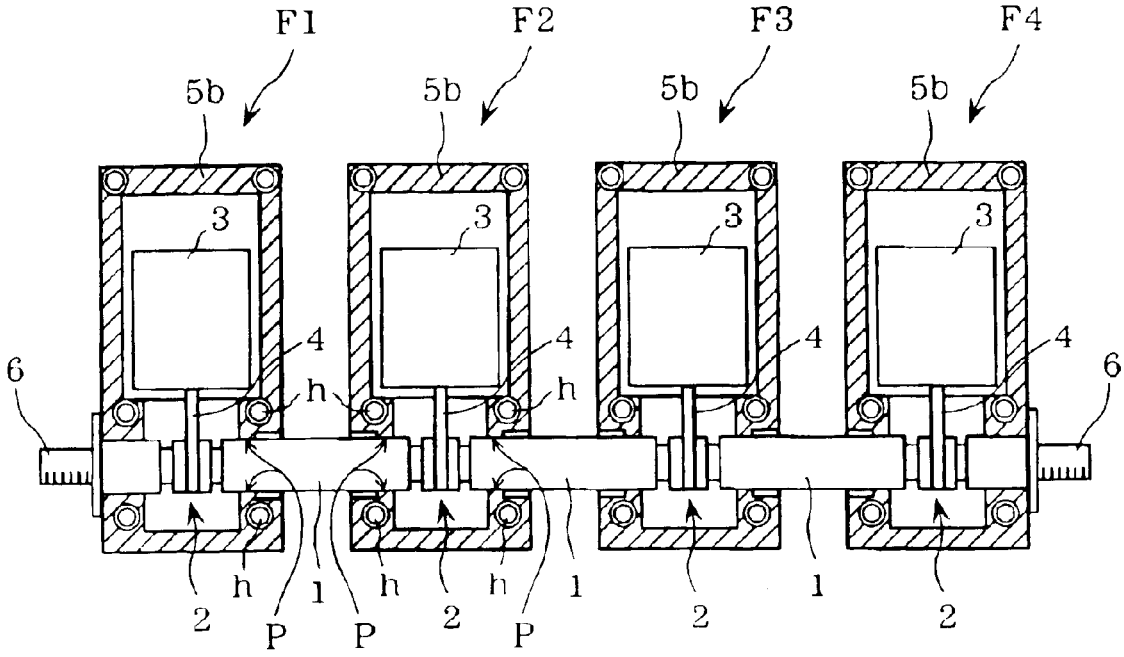
FIG. 2 is a top view showing the band eliminate filter set shown in FIG. 1 in a state with upper housing portions removed.

FIG. 1 is a plan view of the band eliminate filter set, and FIG. 2 shows the inside of components of the band eliminate filter set. The band eliminate filter set has 1-stage band eliminate filters F1, F2, F3, and F4, a coaxial cable 1 for connecting the band eliminate filters F1, F2, F3, and F4, and a coaxial connector 6.

As FIG. 2 shows, the band eliminate filter set includes transverse-electromagnetic-mode (TEM-mode) coaxial dielectric resonators 3 and coaxial capacitors 2 inserted in predetermined positions in the coaxial cable 1. The coaxial cable 1 is a semi-rigid cable in which the surface of an inner conductor is coated with insulating resin and the coated surface is covered with copper material forming a tube as an external conductor. The band eliminate filter set also has connecting conductors 4 for connecting the inner conductors of the resonators 3 and the external conductors of the coaxial capacitors 2, and lower housing portions 5*b*. The lower housing portions 5*b* and upper housing portions which combine therewith operate as a ground conductor path for establishing conduction between two external conductors of the coaxial cable 1 which are separated by each provided coaxial capacitor 2. Inside a housing formed by both housing portions, the coaxial cable 1, the resonators3, and the connecting conductors 4 are accommodated.

Figure 3A:
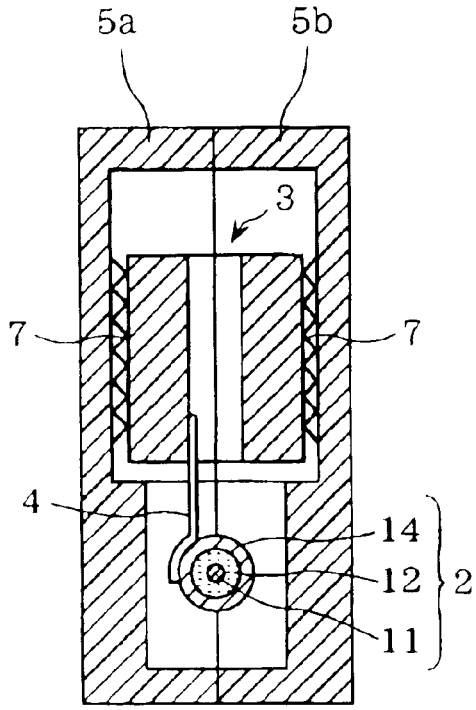
FIGS. 3A and 3B are sectional views showing main components of the band eliminate filter shown in FIG. 1.
Figure 3B:
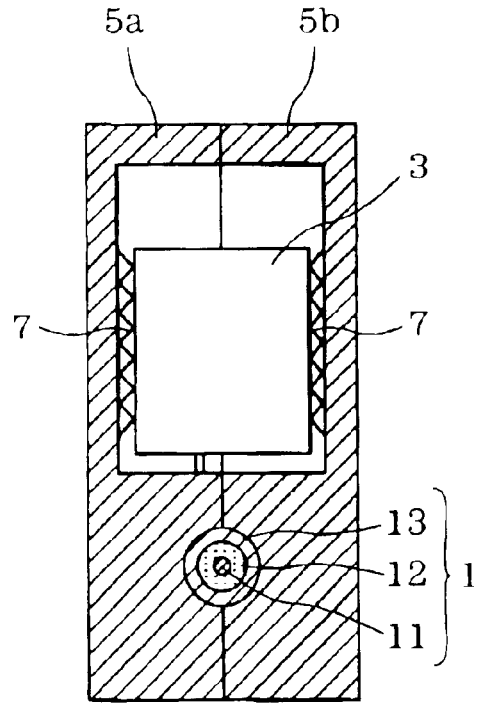

FIGS. 3A and 3B are longitudinal section views of a 1-stage band eliminate filter. FIG. 3A is a section view taken on the line A—A shown in FIG. 1. FIG. 3B is a section view taken on the line B—B shown in FIG. 1.

FIG. 3A is an illustration including a section of the coaxial capacitor 2. The section includes an inner conductor 11 of the coaxial cable 1, an insulating material 12 surrounding the inner conductor 11, and a capacitance conductor 14. The inner conductor 11 and the insulating material 12 are original portions of the coaxial cable 1. The capacitance conductor 14 is a piece of metal provided in an external-conductor-removed portion in a predetermined position of the coaxial cable 1. The external-conductor-removed portion is a portion of the coaxial cable 1 in which a portion of the external conductor of the coaxial cable 1 is removed in a band shape, and the piece of metal as the capacitance conductor 14 is wound around the insulating material 12 in the external-conductor-removed portion so as not to touch the external conductor of the coaxial cable 1.

As described above, by using the coaxial cable 1 as a transmission line, and using the coaxial capacitors 2 as capacitors for coupling the resonators of the coaxial cable 1, the gap between two electrodes can be broadened, thus eliminating the problem of discharge at high power (high voltage). In accordance with an increased distance between the capacitance conductor 14 (piece of metal) and the inner conductor 11, the area of the capacitance conductor 14 is not too small. This relaxes the dimension precision required for the capacitance conductor 14 (piece of metal). Also, assembly of those components is facilitated, thus suppressing a difference in capacitance due to a difference in assembly. As a result, band-eliminate-filter characteristics having less difference are obtained. Moreover, since the coaxial capacitor 2 has Q higher than that of a chip capacitor and a capacitor on a microstrip line, it can reduce an insertion loss in the pass band in the vicinity of the attenuation range.

Each resonator 3 is formed by forming an inner conductor on the inner surface of a cylindrical dielectric material and forming an external conductor on the outer surface of the dielectric material. The resonator 3 operates as a quarter-wavelength coaxial resonator or a half-wavelength resonator. The connecting conductor 4 has an end connected to the capacitance conductor 14, and the other end connected to the inner conductor of the resonator 3. The connecting conductor 4 operates as a distributed-constant line, and the line has a dominant inductance component. Accordingly, in a lumped-constant circuit view, the resonator 3 is connected to the transmission line by an inductor.

Spring earth plates 7 are provided between the housing portion 5*a* and the resonator 3 and between the housing portion 5*b* and the resonator 3, whereby the resonator 3 is elastically maintained in a mechanical manner to the housing portions 5*a* and 5*b*, and the external conductor of the resonator is electrically connected to the housing portions 5*a* and 5*b*.

FIG. 3B is a sectional view of a portion in which the coaxial cable 1 is provided between the housing portions 5*a* and 5*b*. The coaxial cable 1 consists of the inner conductor 11, the insulating material 12, and an external conductor 13. The housing portions 5*a* and 5*b* are in conduction by touching the external conductor 13. In particular, screw holes h in FIG. 2 for joining each pair of the housing portions 5*a* and 5*b* are provided in the vicinities of portions touching the external conductor 13 of the coaxial cable 1. This structure ensures that earth connection is established between the external conductor 13 of the coaxial cable 1 and the housing portions 5*a* and 5*b*. In addition, the housing portions 5*a* and 5*b* are molded so that each portion in which the housing portions 5*a* and 5*b* touch the external conductor 13 is close to the external-conductor-removed portion. This reduces a necessary earth current to flow into the inside, thus preventing a spurious wave from being generated.

Figure 4:
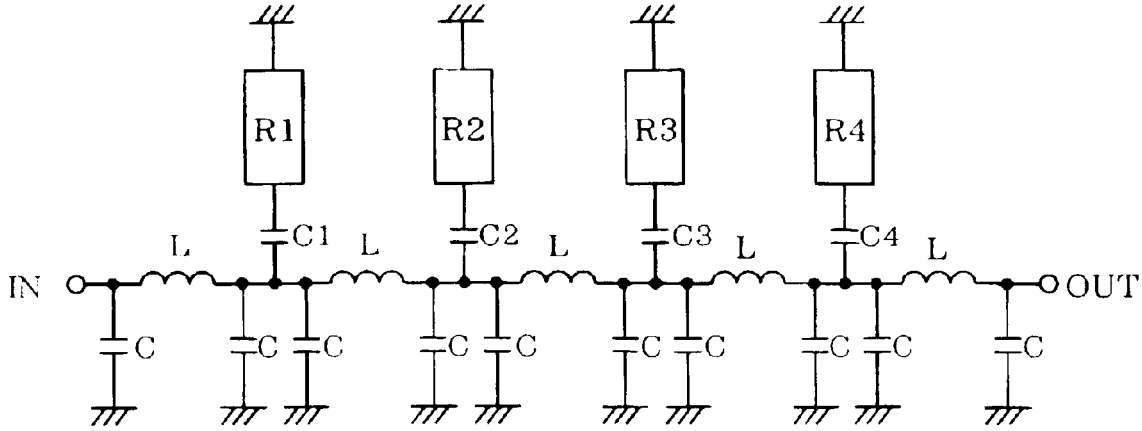
FIG. 4 is an equivalent circuit diagram of the band eliminate filter shown in FIG. 1.

FIG. 4 is an equivalent circuit diagram of the band eliminate filter set. In FIG. 4, components R1 to R4 correspond to the resonators 3 in the band eliminate filters F1 to F4 in stages, respectively. Capacitors C1 to C4 correspond to the coaxial capacitors 2 in the band eliminate filters F1 to F4 in stages, respectively. A circuit composed of inductors L and capacitors C represents the distributed constant circuit of the coaxial cable 1. As FIG. 2 shows, the band eliminate filter set has a structure in which a plurality of coaxial capacitors are inserted in predetermined positions of the coaxial cable 1. This structure has a relationship in which an interval (electrical length) between adjacent coaxial capacitors 2 is approximately a quarter of the wavelength of a signal transmitted through the coaxial cable 1. Alternatively, the electrical length required for satisfying predetermined characteristics is used. This obtains an operation of a band eliminate filter including resonators in four stages.

Next, a band eliminate filter according to a second embodiment of the present invention is described below with reference to FIGS. 5 and 6.

Although the first embodiment forms a band eliminate filter set having a predetermined number of stages, the second embodiment forms a band eliminate filter set having a predetermined number of stages by unitizing band eliminate filters in the stages and combining the band eliminate filter units.

Figure 5:
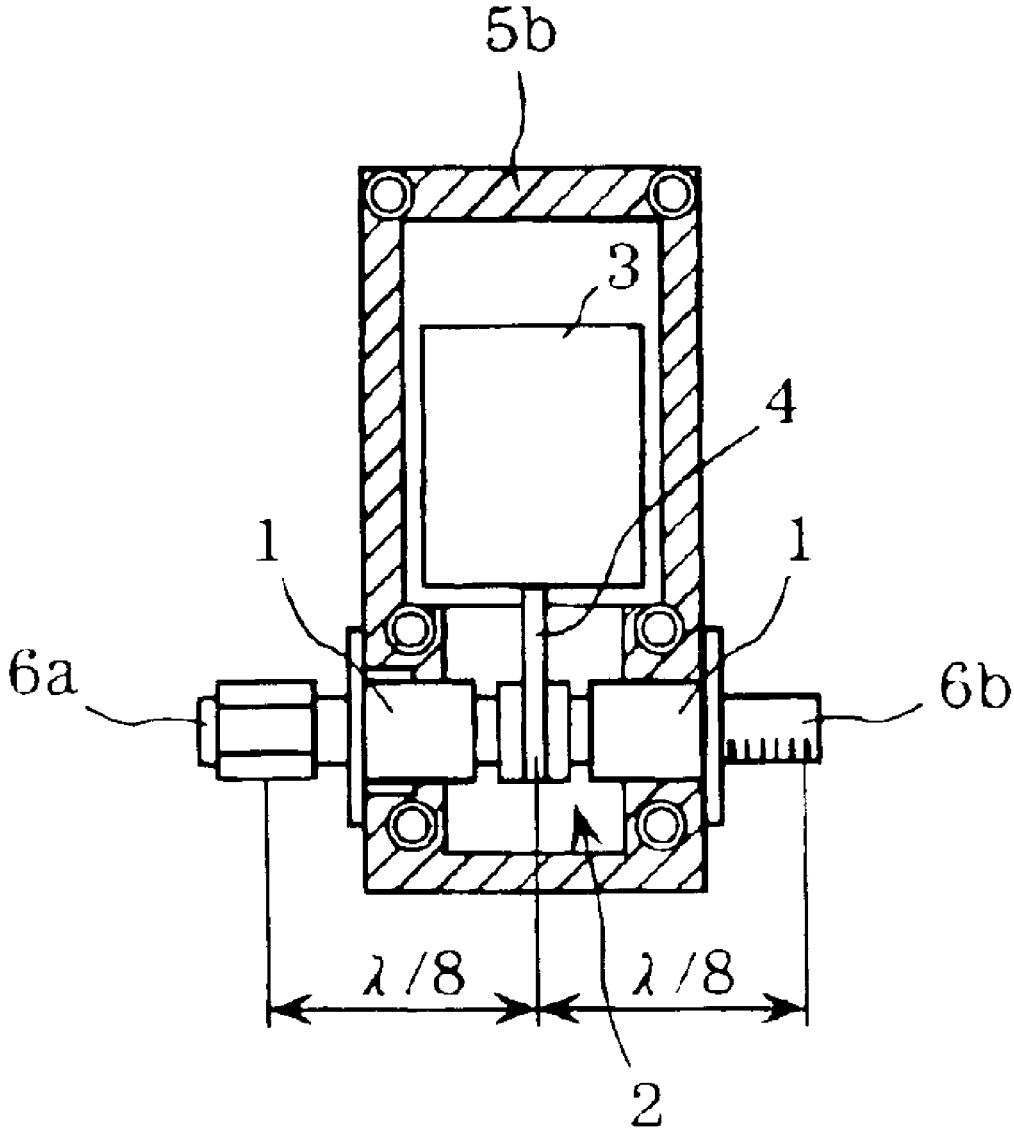
FIG. 5 is a sectional view showing the internal structure of a band eliminate filter as a unit according to a second embodiment of the present invention.

FIG. 5 is a sectional view of a band eliminate filter unit. In the band eliminate filter unit, a coaxial capacitor 2 is inserted between coaxial cables 1. A lower housing portion 5*b* and an upper housing portion combining therewith operate as a ground conductor path. Inside the housing formed by both housing portions 5*a* and 5*b*, a resonator 3 and a grounded conductor 4 are accompanied together with the coaxial capacitor 2. Similar to the first embodiment, the upper housing portion (corresponding to the housing portion 5*a* in FIG. 3) is screwed on the lower housing portion 5*b*. Coaxial connectors 6*a* and 6*b* are fixed to the housing portion 5*b*, and their internal conductors are in conduction to the internal conductor of the coaxial cable 1. One coaxial connector 6*a* is of a male type, while the other coaxial connector 6*b* is of a female type.

The electrical length between the center of the coaxial capacitor 2 and each of ends of the coaxial connectors 6*a* and 6*b* is set to be approximately an eighth of the wavelength at the central frequency of the elimination band on the coaxial cable 1.

Figure 6:
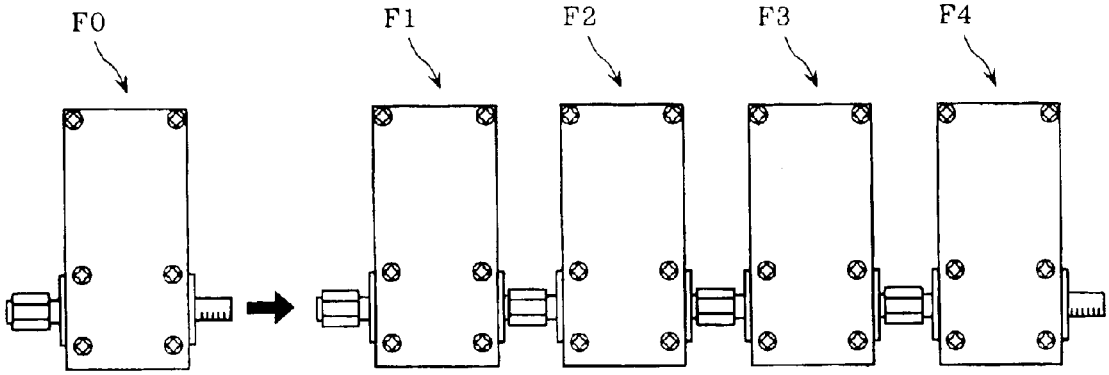
FIG. 6 is a plan view showing a band eliminate filter set composed of a plurality of elements.

FIG. 6 shows a state in which a plurality of band eliminate filter units F0 to F4 in stages are sequentially connected to one another, with each unit as the band eliminate filter shown in FIG. 5. Since the coaxial connector 6*a* is of a male type, and the other coaxial connector 6*b* is of a female type, the units can be sequentially connected in cascade. The band eliminate filter units F0 to F4 each have the structure shown in FIG. 5. In this state, the electrical length between adjacent coaxial capacitors 2 is approximately a quarter wavelength. As a result, in the structure shown in FIG. 6, resonators are connected to a transmission line at intervals of approximately a quarter wavelength.

According to this structure, by adjusting the band eliminate filter units F0 to F4 as filters each coping with one peak in an attenuation range, and connecting them, a multistage band eliminate filter can be easily formed. Therefore, a production process can be facilitated, and also assembly automation can be facilitated. In addition, adjustment of the units can be separately performed, so that the adjustment is very easy and the total production cost can be greatly reduced.

Components for forming a multistage band eliminate filter can be formed by components standardized in units of elements. Thus, the standardization achieves cost reduction. In addition, a multistage band eliminate filter complying with a customer's demand can be easily formed, thus greatly shortening design and production periods.

In the above embodiments, TEM-mode coaxial dielectric resonators are used. Instead, resonators using the transverse magnetic (TM) and transverse electric (TE) modes may be provided.

In the example in FIG. 2, the internal conductor and insulating material of the coaxial cable 1 are also used as the internal conductor and surrounding insulating material of the coaxial capacitor 2. However, by using a coaxial capacitor as a component separate from the coaxial cable 1, the coaxial capacitor may be inserted in the coaxial cable 1. This case has a structure similar to that shown in FIG. 2.

In the example in FIG. 3, by removing the external conductor 13 of the coaxial cable 1 in a band shape, and providing the capacitance conductor 14 in the portion with the external conductor 13 removed, a coaxial capacitor is formed. However, by partially removing the insulating material 12 together with the external conductor 13, the inner conductor of the coaxial cable 1 may be used as the inner conductor of the coaxial capacitor 2.

Moreover, separately from the coaxial capacitor 2, another capacitor for adjusting coupling capacitance may be additionally provided. Also, in addition to the connecting conductor 4, an inductor may be connected in series to the connecting conductor 4.

Next, a communication apparatus according to a third embodiment of the present invention is described below with reference to FIG. 7.

Figure 7:
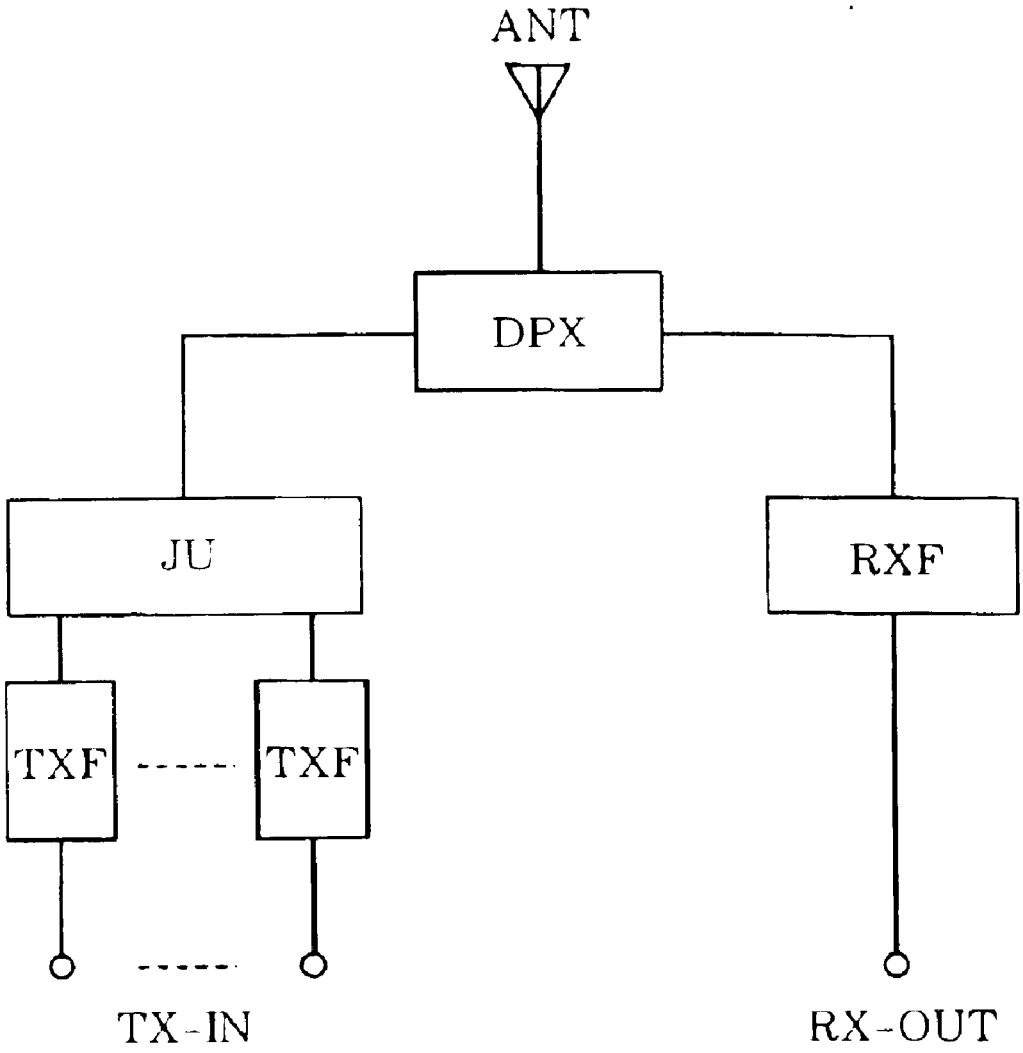
FIG. 7 is a block diagram showing a communication apparatus.
Figure 8A:
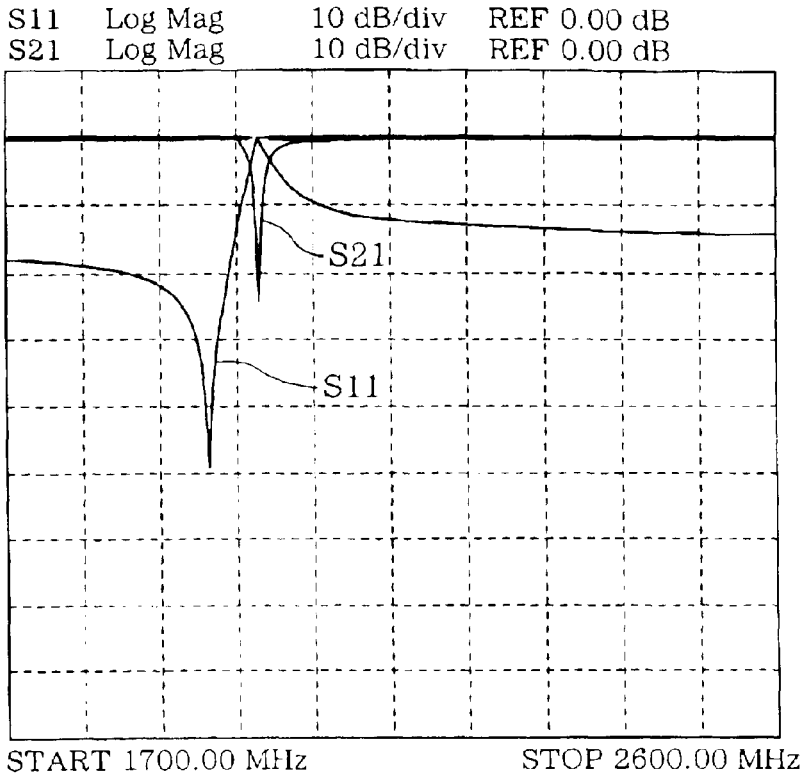
FIG. 8A PRIOR ART
FIGS. 8A and 8B are graphs each showing changes in filter characteristics which are caused by a change in a coupling capacitor in a band eliminate filter of the related art.
Figure 8B:
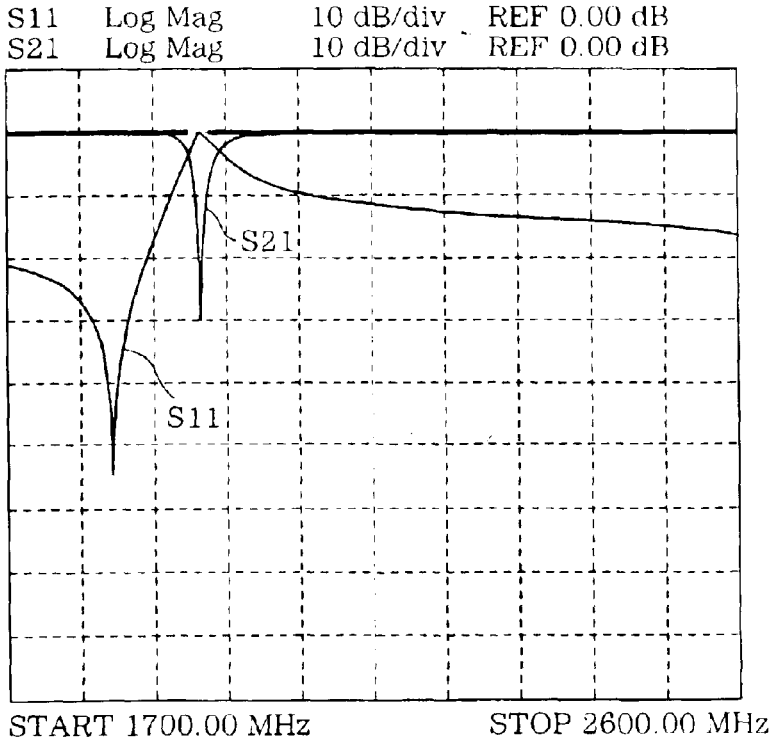
FIG. 8B PRIOR ART

FIG. 7 shows the configuration of a base station in a mobile communication system. The base station includes an antenna ANT, a duplexer DPX, transmission filters TXFs for transmission channels, a junction unit JU for mixing transmitting signals passing through the transmission filters TXFs, and a receiving filter RXF which allows a received frequency band to pass through it and which eliminates an unnecessary frequency band. A band eliminate filter as described in the first or second embodiment is used in the receiving filter RXF. Its elimination band is set to, for example, a transmission frequency band.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A band eliminate filter comprising:

a coaxial line having two external conductor portions;

a coaxial capacitor inserted between said two external conductor portions;

a ground conductor path for establishing electrical conduction between each of said two external conductor portions of said coaxial line which are separated by the inserted coaxial capacitor; and a resonator connected to junctions of the external conductor portions and said ground conductor path.

2. The band eliminate filter according to claim 1, wherein said coaxial line is a semi-rigid cable in which the surface of an inner conductor of said cable is coated with insulating resin and the coated surface is covered with metal so as to form the two external conductor portions.

3. The band eliminate filter according to claim 2, wherein said coaxial capacitor includes a capacitance conductor that is a piece of metal which is wound around a band shape and which has no contact with said two external conductor portions of said coaxial line.

4. The band eliminate filter according to claim 1, wherein a coaxial connector is provided in each of two positions which are separated from a center of the coaxial capacitor along said coaxial line in a signal transmitted direction and an opposite direction thereto by approximately an eighth of a wavelength at a central frequency of an elimination band.

5. A communication apparatus including the band eliminate filter according to claim 1.

6. A band eliminate filter comprising:

a coaxial line having two external conductor portions;

a coaxial capacitor inserted between said two external conductor portions;

a ground conductor path for establishing electrical conduction between each of said two external conductor portions of said coaxial line which are separated by the inserted coaxial capacitor; and a resonator connected to junctions of the external conductor portions and said ground conductor path, wherein said coaxial capacitor includes a portion of an inner conductor of said coaxial line in which an external conductor in a portion of said coaxial line is removed in a band shape, and a capacitance conductor which combines with the portion of the inner conductor to generate an electrostatic capacitance.

7. The band eliminate filter according to claim 6, wherein said coaxial line is a semi-rigid cable in which the surface of said inner conductor is coated with insulating resin and the coated surface is covered with metal, the metal forming the two external conductor portions.

8. The band eliminate filter according to claim 6, wherein said capacitance conductor is a piece of metal which is wound around the band shape and which has no contact with said two external conductor portions of said coaxial line.

* * * * *